United States Patent [19]

Taylor

[11] Patent Number: 4,838,625

[45] Date of Patent: Jun. 13, 1989

[54] ROTARY CLOSET WARDROBE

[76] Inventor: William D. Taylor, 5448 Encina Dr., San Diego, Calif. 92114

[21] Appl. No.: 229,718

[22] Filed: Aug. 8, 1988

[51] Int. Cl.[4] ..... A47B 49/00

[52] U.S. Cl. ..... 312/252; 312/305; 211/163

[58] Field of Search ..... 312/252, 305, 202; 211/163, 205, 78

[56] References Cited

U.S. PATENT DOCUMENTS

| | | | |
|---|---|---|---|
| 623,396 | 4/1899 | Crowder | 312/252 X |
| 1,101,849 | 6/1914 | Hines | 312/252 X |
| 1,929,677 | 10/1933 | Davis | 312/252 X |
| 2,125,045 | 7/1938 | Connelly | 211/163 |
| 2,204,502 | 6/1940 | Krauss | 211/163 X |
| 2,326,064 | 8/1943 | Pittman | 312/305 |
| 4,332,378 | 6/1982 | Pryor | 211/205 |
| 4,390,099 | 6/1983 | Trautlein et al. | 211/163 X |

*Primary Examiner*—Joseph Falk

*Attorney, Agent, or Firm*—Lewis E. Massie; Andsel Group

[57] ABSTRACT

A rotary closet wardrobe mounted on a vertical column extending from floor to ceiling of a clothes closet having three rows of drawers on the top portion. Immediately below the drawers a horizontal bar supports an elliptical shaped horizontal clothes hanger rod providing rotational clearance for clothes suspended on clothes hangers in the typical modern home closet. Beneath the clothes hanger a cylindrical structure having two vertical layers of bins rotatable around the vertical column mounted on the floor of the closet.

1 Claim, 1 Drawing Sheet

FIG. 1
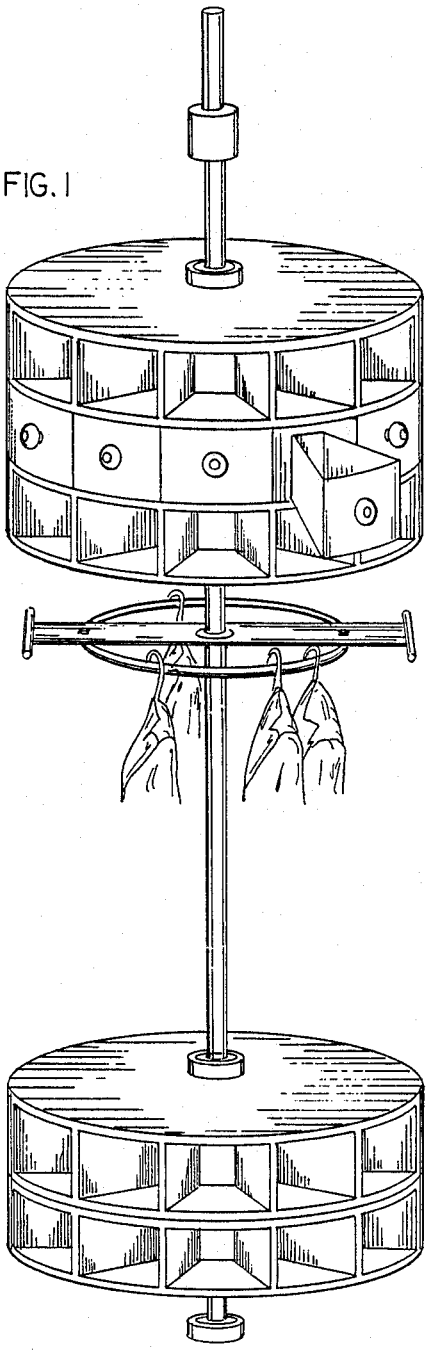
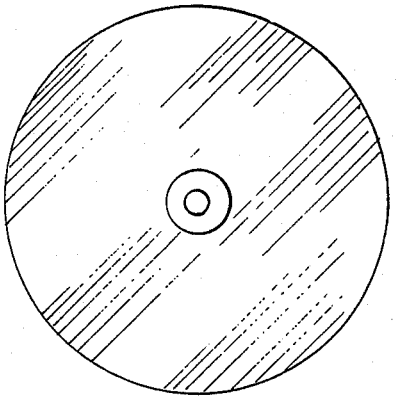
FIG. 2
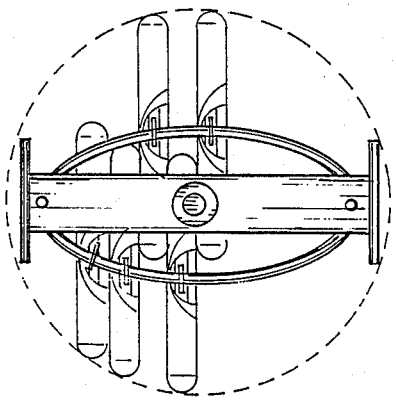
FIG. 3

ROTARY CLOSET WARDROBE

BACKGROUND OF THE INVENTION

1. Field of the Invention

The instant invention relates to rotatable structures for storing clothes and accessories that can be installed in typical clothes closets in modern homes.

2. Description of the Prior Art

The referenced U.S. Patents describe a variety of rotating garment closets and wardrobes showing a vertical column supporting rotatable clothes hangers, storage drawers, bins and shelves. The most pertinent prior art is U.S. Pat. No. 2,326,064 issued to Pittman in 1943.

SUMMARY OF THE INVENTION

The primary objective of the instant invention is to provide a rotary wardrobe structure compatible with the architectural limitations of clothes closets constructed in modern houses. The closets constructed in modern houses are limited in depth with a front to back dimension rarely exceeding thirty inches. A typical clothes hanger holding a a light garment measures a minimum of seventeen inches shoulder to shoulder. A heavy garment such as a top coat this dimension can exceed nineteen inches A circular support ring mounted horizontally in the typical closet supporting clothes hangers around the circumference would have a diameter in excess of forty inches.

The instant invention reconciles these limiting dimensions by providing an elliptical horizontal ring rotating around the vertical axis having the clothes hangers alternatingly supported around the circumference. The elliptical ring supported by a longitudinal member having a bearing at the center affixed to the vertical column. A three layer circular structure containing shelves and drawers is mounted above the elliptical clothes hanger and a two layer structure having bins is mounted on the floor beneath the clothes hanger assembly.

BRIEF DESCRIPTION OF THE DRAWINGS

FIG. 1 is a top front perspective view of the rotatable wardrobe structure;

FIG. 2 is a top view of the rotatable wardrobe structure;

FIG. 3 is a sectional view through 1—1 of FIG. 1.

DETAILED DESCRIPTION OF THE PREFERRED EMBODIMENT

Referring to FIG. 1 the vertical column 1 extending from the floor to ceiling of the closet is shown with the cylindrical assembly 2 consisting of a plurality of drawer enclosures 6 and drawers 7 with knobs 10 extending radialy from the vertical column 1. Immediately beneath the cylindrical assembly 2 rotatably mounted on the vertical column 1 by bearing 3 the horizontal clothes hanger support 4 supporting elliptical hanger rod 5. Horizontal bars 8 are attached to each end of support 4. Mounted on the floor axially around the vertical column 1 is a two layer circular structure 11 having a plurality of horizontal bins 9 extending radialy from the vertical column 1.

I claim:

1. A wardrobe structure rotatable in the horizontal plane around a vertical support column extending from floor to ceiling in a clothes closet wherein the improvement comprises:

a. the top section of the rotatable wardrobe structure having three vertical rows of pie shaped drawer enclosures extending radialy from the vertical support column;

b. immediately below the drawer enclosure structure a horizontal clothes hanger support bar rotatably supported by a bearing on the vertical column;

c. a clothes hanger rod in the shape of a horizontal ellipse suspended beneath the clothes hanger support rod;

d. two vertical circular rows of pie shaped bins extending radialy from the vertical support column rotatably mounted on the vertical column on the floor beneath the wardrobe structure.

* * * * *